US010053843B2

(12) United States Patent
Walton

(10) Patent No.: US 10,053,843 B2
(45) **Date of Patent: *Aug. 21, 2018**

(54) MAGNETIC SINK FLANGE RETAINER AND METHOD

(71) Applicant: Tiffany Walton, Beverly Hills, CA (US)

(72) Inventor: Nic Walton, Bend, OR (US)

(73) Assignee: Tiffany Walton, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/351,240

(22) Filed: Nov. 14, 2016

(65) Prior Publication Data

US 2017/0058499 A1 Mar. 2, 2017

Related U.S. Application Data

(63) Continuation-in-part of application No. 12/889,362, filed on Sep. 23, 2010, now Pat. No. 9,493,935.

(60) Provisional application No. 61/245,216, filed on Sep. 23, 2009.

(51) Int. Cl.

| | |
|---|---|
| ***E03C 1/042*** | (2006.01) |
| ***E03C 1/22*** | (2006.01) |
| ***E03C 1/266*** | (2006.01) |

(52) U.S. Cl.
CPC ..... *E03C 1/22* (2013.01); *E03C 1/266* (2013.01)

(58) Field of Classification Search
CPC ..... E03C 1/22; E03C 1/266
USPC ..... 4/695
See application file for complete search history.

(56) References Cited

U.S. PATENT DOCUMENTS 3,652,054 A * 3/1972 Layton ..... F16K 31/0651 251/65
5,208,921 A * 5/1993 Nicoll ..... E03C 1/23 4/286

* cited by examiner

*Primary Examiner* — Huyen Le
(74) *Attorney, Agent, or Firm* — Donn K. Harms

(57) ABSTRACT

A support device to maintain a mounting assembly on the exterior of a sink flange engaged to a sink adapted to engage a garbage disposal. The support device employs a body portion engaged to one or a plurality of magnets. The body portion is adapted to engage with or upon the sink flange and thereby position the magnets to magnetically hold the mounting assembly upon the exterior of the sink flange.

17 Claims, 3 Drawing Sheets

MAGNETIC SINK FLANGE RETAINER AND METHOD

This application is a continuation in part application to U.S. application Ser. No. 12/889,362, filed on Sep. 23, 2010, which claims benefit to U.S. Provisional Patent Application No. 61/245,216 filed on Sep. 23, 2009.

FIELD OF THE INVENTION

The disclosed device relates to plumbing. More particularly, the disclosed device and method relate to a sink hardware installation aid which is configured to magnetically maintain a ring assembly upon a garbage disposal mounting flange and thereby allow the installer to employ two hands during an engagement of the required snap ring on the flange.

BACKGROUND OF THE INVENTION

In modern countries such as the United States and Canada, the sink-mounted garbage disposal has become a common fixture in the sinks of homes and businesses. Essentially the disposal is a grinder affixed to a drain outlet under the sink which grinds food and materials thrown into the drain into material small enough to be flushed through the drainpipes.

Because disposals contain electric motors, gears, and have a strong housing, garbage disposal units tend to be heavy. Consequently, mounting a heavy device to the bottom end of a conventional sink flange adapted to engage the disposal requires a flange up to the task of both support and obtaining a waterproof seal. Conventionally, rotationally engaged sink drain flanges, which are engaged to both the sink and the garbage disposal, are employed to create a compression fit of the disposal to the sink, in a leak-proof engagement.

During the installation process, the plumber or installer of a sink-mounted disposal unit generally lays down upon his back with his head under the sink. While in this cramped uncomfortable position, the installer must then manipulate the disposal into place in the dark and tight space under the sink. While holding the heavy disposal elevated and perpendicular to the ground, the plumber must then accurately rotationally engage a pair of flanges to mount the disposal to the sink.

Conventionally, the engagement components employed in this mount have evolved a commonality amongst manufacturers. A majority of such garbage disposal units are engaged to the underside of a sink using triangular attachment ring engaged to drain-mounted flange which communicates through an aperture formed in the sink.

The attachment ring is actually an assembly which is formed of upper and lower ring components and a sink flange having a barrel portion. These ring components are removably engaged together by three screws. A centrally positioned aperture in both ring components allows insertion of the barrel portion of the sink flange through both the upper and lower ring components.

Engagement of the attachment ring assembly to the sink flange conventionally requires two people for what should be a one person job. During installation of the flange to the sink drain aperture, the sink flange is engaged through a sink opening and a circular ledge of the flange is pressed into a layer of plumber's putty pre-positioned on the upper surface of the sink. Once so positioned, with the distal end of the cylindrical flange descending through the sink opening and below the sink, another person is enlisted to hold the sink flange in place in the sink opening while the installer works from under the sink to engage the attachment ring assembly over the distal end of the sink flange.

The installer, during the attachment ring engagement, having slid the assembled attachment ring assembly over the distal end of the barrel portion of the flange, must subsequently engage an inwardly-biased snap ring or clip over a depression adjacent to the distal end of the sink flange. This snap ring, once so engaged, maintains the ring assembly engaged upon the flange. Thereafter, the three screws are tightened to pull upon and seal the ledge extending from the upper end of the sink flange into the plumber's putty surrounding the drain opening.

As can be surmised, the act of expanding an inwardly biased "C" clip or snap ring to a sufficient diameter to slide over the distal end of the barrel end of the flange to an engagement in the flange depression is an awkward task. To complicate matters, the installer is lying on his back, reaching upward from a position under the sink. As they must concurrently hold the ring assembly upon the distal end of the barrel end of the flange with one hand, this leaves only one other hand to accomplish this awkward task of expanding the snap ring and engaging it on the barrel of the flange.

All the while, the second person may be holding the top end of the flange in position. As a result, installers frequently endure numerous failures in their attempt to engage the snap ring upon the flange with only a single hand, while concurrently holding the sink assembly in place. As such, homeowners, as well as professional installers, can become frustrated to say the least, and homeowners may simply give up and call a plumber rather than handle the task themselves.

As a consequence of the state of the art, there exists an unmet need for a tool configured to hold the ring assembly in place, surrounding the middle portion of the descending barrel upon the flange. Such a tool should serve to position the ring assembly above the annular recess at the distal end of the barrel of the flange. Such a ring assembly holding tool should hold the ring assembly in place, without the snap ring or C-clip being installed, and thereby position it for allowing an easy access to the annular recess which is specifically adapted to engage the snap ring. Such a device as such, should provide a means to allow the user to employ two hands to expand and engage the snap ring within the recess, without the need to concurrently support the ring assembly.

In this respect, before explaining at least one embodiment of the tool for a magnetic garbage disposal ring assembly engagement invention in detail, it is to be understood that the invention is not limited in its application to the details of construction and to the arrangement of the components set forth in the following description or illustrated in the drawings nor the steps outlined in the specification. The invention is capable of other embodiments and of being practiced and carried out in various ways as those skilled in the art will readily and immediately ascertain from reading this application. Also, it is to be understood that the phraseology and terminology employed herein are for the purpose of description and should not be regarded as limiting.

As such, those skilled in the art will appreciate that the conception upon which this disclosure is based may readily be utilized as a basis for designing other methods and systems for carrying out the several purposes of the present invention which is a significant improvement to the task of engaging a garbage disposal flange to the ring assembly with a snap ring. It is important, therefore, that the claims be regarded as including such equivalent construction insofar as they do not depart from the spirit and scope of the present invention.

OBJECTS OF THE INVENTION

An object of this invention is the provision of a tool to operatively maintain the ring assembly surrounding a garbage disposal flange in place without the snap ring.

An additional object of this invention is the provision of such a tool which also allows an installer to use two hands to install the snap ring upon the flange, while the ring assembly is temporarily held in place.

These together with other objects and advantages which will become subsequently apparent reside in the details of the construction and operation of the device herein as more fully hereinafter described and claimed, reference being had to the accompanying drawings forming a part thereof, wherein like numerals refer to like parts throughout.

SUMMARY OF THE INVENTION

The device as shown and described in the various preferred embodiments, when employed for the task noted above, provides the user with a stable and easy method to position and hold the ring assembly around a middle portion of the extending barrel of a sink-engaged garbage disposal mounting flange in a position between the bottom of the sink and the distal end of the barrel of the flange.

All modes of the device employ one or a plurality of magnets are engaged to a body portion which is adapted to engage with or upon, the flange to thereby position the magnet or magnets adjacent an in the axial passage communicating through the flange. The body of the disclosed device is sized to have at least a portion thereof located within the axial passage, or to be supported upon the ledge of the flange where it engages the sink. If inserted within the axial passage, a projecting ledge at an upper end of the body of the device is configured to support the body within the vertically disposed flange as a means to prevent it from falling through the passage. If supported upon the ledge of the flange, or within the axial passage, the body is configured in its engagement with a magnet or magnets, to position one or a plurality of such magnets within the axial passage in position to communicate a magnetic field with will magnetically attract and hold the ring assembly on the outside surface of the flange.

The magnetic attraction from the magnet or magnets engaged with the body of the device is sufficient in strength to communicate the magnetic field through the flange as a means to attract the assembled ring assembly and hold it in place. The ring assembly is thus held in place by the magnetic field, in a position surrounding a middle portion of the flange, where it is to be engaged.

In use, with the body of the device positioned, the user simply slides the ring assembly over the distal end of the sink-engaged flange, and onto a mid portion of the barrel of the flange. Once so positioned, the magnetic attraction generated from the magnet or magnets of the device herein, will hold the ring assembly in place and allow the installer to disengage their hand therefrom. With both hands free, thereafter, the installer may employ both hands to engage the snap ring of the ring flange, upon the barrel of the flange. Once so engaged, the snap ring will then prevent the ring assembly from sliding off the distal end of the flange which provides the mount to operatively support an underlying garbage disposal.

In a first mode of the device, a plurality of magnets, for example three magnets, are positioned at substantially equidistant points around the circumference of the body of the device. A second mode of the device enabling the method herein employs a circular magnet which communicates around the body adjacent to its circumference. Another mode of the device herein employs a plurality of two magnets on opposite ends of an elongated member. The elongated member, in this mode, is adapted to fit across the diameter of the axial passage of the flange, and contact the sloping sides thereof to hold position. Of course, other embodiments as would occur to those skilled in the art on reading this disclosure may surely be employed and are considered in the scope of this patent since any mounting body engaged to a magnet in a position suspending the magnet in adjacent or within the axial passage of the sink-mounted flange, where the magnetic attraction therefrom will attract and hold the mounting ring of a garbage disposal, is considered within the scope of this application.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing description and following detailed description are considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DETAILED DESCRIPTION OF THE INVENTION

Figure 1:
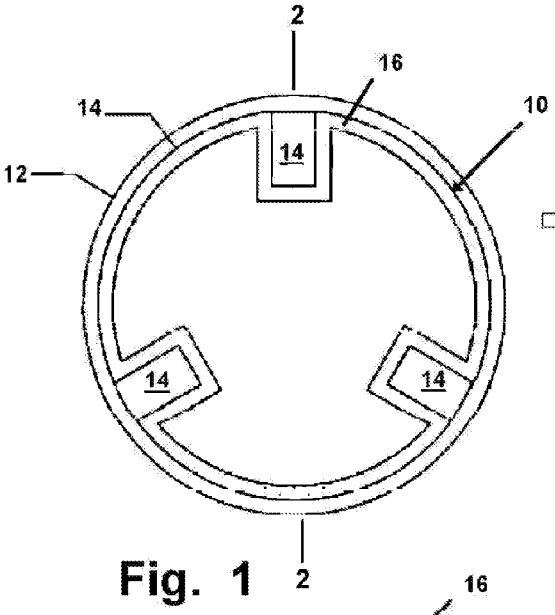
FIG. 1 depicts a bottom plan view of a mode of the device having a plurality of three magnets positioned equidistant around a circular body.

Referring now to the drawings in FIGS. 1-8, wherein similar parts of the device 10 are identified by like reference numerals, the device 10 is shown in various modes, all of which employ a body 16 engaged to one or a plurality of magnets 14, which are engaged with the body 16 at a position or positions which suspend the one or a plurality of magnets 14, adjacent to a side of the flange 12 preferably within the axial cavity of the drain flange 12, which is conventionally engaged within the drain aperture 13 of a sink. The magnet 14 or magnets 14 are engaged to positions on the body 16 such that when so suspended, at a position in the axial passage 11 of the flange 12, a magnetic flux generated from the magnet 14 provides the an attractive force to a ring assembly 18, as a means to maintain a ring assembly 18 about the circumference of the flange 12, without the user needing to hold it with their hand.

The body 16 may be adapted to frictionally engage within the axial passage 11, or more preferably for ease of use, may be adapted to be supported by the ledge 27 of the flange 12, so long as the body 16 has the magnet 14 or magnets 14 engaged to positions thereon, where the magnet 14 or magnets 14 are suspended in a position within or adjacent the axial passage 11, where their magnetic field will magnetically attract and hold the ring assembly 18, upon the exterior of the flange 12.

Figure 7:
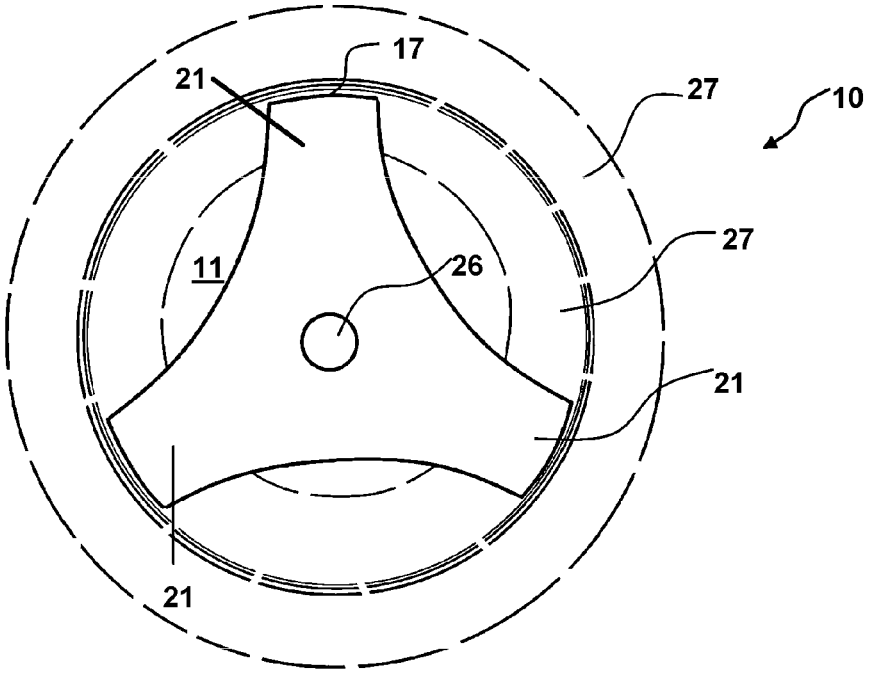
FIG. 7 depicts a mode of the device having a body with three legs forming a triangular shape where a magnet is positioned upon each leg.

There is seen in FIG. 1 a bottom plan view of one preferred mode of the device 10. The perimeter edge 17 of the body 16 of this mode of the device 10 is curved or circular in shape and is sized to operatively engage within the axial passage 11 running axially through a conventional sink drain flange 12, or be positioned on the ledge 27 which in some cases such as shown in FIG. 7, slopes toward the interior of the drain flange 12.

In the mode of FIG. 1, the magnetic attraction is generated by the magnet 14 or magnets 14 to attract the ring assembly 18 which must be conventionally engaged to the exterior of sink-engaged flange 12 in order to support the later-mounted garbage disposal, is generated by the depicted plurality of magnets 14 positioned upon a body 16, which is preferably formed of plastic or other material adapted to the task. The magnets 14 so positioned on the body 16, once the body 16 is engaged with the flange 12, generate a magnetically attractive force to the attachment ring 18 shown in FIG. 4. In this fashion, the attachment ring 18 is maintained in position upon the exterior of the flange 12 at a mid portion of the axial passage 11 running through the barrel portion 19 of the flange 12 when placed there by an installer.

So positioned, the ring assembly 18 is held in this removable engagement to the exterior of the flange 12, by the magnetic attraction provided by the magnet 14 held in operative position in or adjacent the axial passage 11 by its engagement on the body 16 of the device 10. This temporary magnetic attraction from the magnet 14, allows the installer or user to place the attachment ring 18 over the barrel portion 19 of the flange 12, where it is held in position by the magnet 14 or magnets 14. So held, the installer thereafter employ both hands to expand a snap ring 20, which is conventionally installed upon the exterior of the flange 12, adjacent to the distal end of the barrel portion 19 of the flange 12. Once engaged, the snap ring 20, prevents the attachment ring 18 from sliding off the distal end of the barrel portion 19 of the flange 12. This connection provided by the snap ring holds the attachment ring 18 in place, and allows the user to engage a garbage disposal to the attachment ring 18 in the conventional fashion.

This attachment ring 18 so supported on the flange 12 by the snap ring 20, thereafter allows the user or installer, to adjust the screw adjusters 22 on the attachment ring 18 during the installation, to thereby impart pressure against the snap ring 20 in a direction away from the sink 15 bottom. This allows a seal to be formed by the ledge 27 of the flange 12 and a sealant sandwiched between the ledge 27 and the sink 15 bottom. Once installed, the attachment ring 18 as noted, also provides a rotatable engagement to a garbage disposal.

Figure 2:
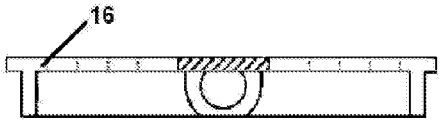
FIG. 2 is a sectional view through FIG. 1 along line 2-2.

FIG. 2 is a sectional view through FIG. 1 along line 2-2 showing the body 16 and magnets 14. As noted, while shown as a plurality of three magnets 14, in the noted figures, one magnet 14 may be employed, or a plurality of magnets 14 may be of any number and size so long as the magnets 14 are attached to the body 16 in positions to provide sufficient magnetic attraction to hold the attachment ring 18, upon the central portion of the barrel portion 19 of the flange 12, for a duration wherein an installer may release their hand from supporting the attachment ring 18 and employ both hands to install the snap ring 20 upon the distal end of the flange 12.

Figure 3:
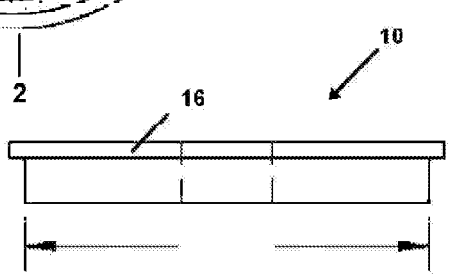
FIG. 3 depicts a side view of the device of FIG. 1.
Figure 4:
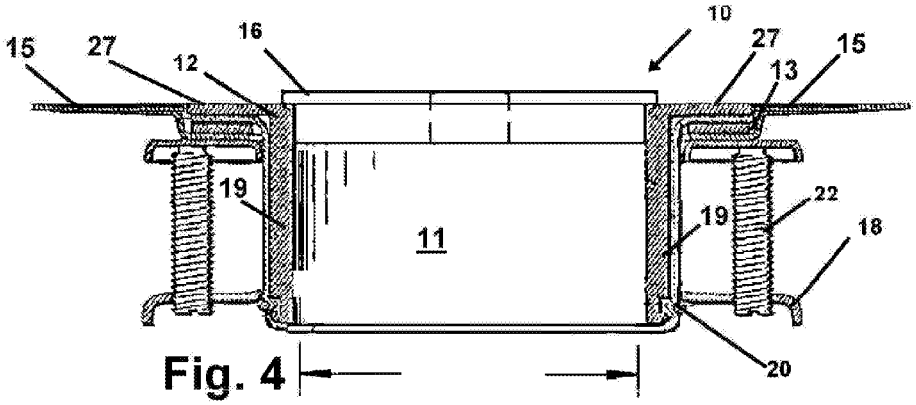
FIG. 4 depicts the device engaged within the first end of the flange engaged within a drain aperture of a sink as all modes of the device would engage the flange.

FIG. 3 depicts a side view of the body 16 of the device 10 of FIG. 1 elevated above the sectional view of the drain of FIG. 4 in which the body 16 of the mode of FIG. 1, and other modes of the device 10 herein, operatively engage to provide a magnetic support by suspending one or more magnets 14 within the axial passage 11 of the flange 12. As shown in FIG. 3, a perimeter edge 17 of the body 16 is sized to hold the body 16 within the flange 12, where the magnets 14 will attract and hold the ring 18 to the flange 12 during installation.

In FIG. 4 the device 10 is engaged within the first end of the flange 12 which itself is engaged within a drain aperture 13 of a sink 15 in a similar fashion to other modes of the device 10. In all modes herein of the device 10, the body 16 is adapted to engage with our sit upon the flange 12 in some fashion where the engaged magnet 14 or magnets 14 are operatively positioned to provide the means for magnetic attraction, communicating through the barrel portion 19 of the flange 12, where it will hold the attachment ring 18 thereon in a magnetic engagement. This allows the installer to use both hands to connect it without worry of a dismount.

Figure 5:
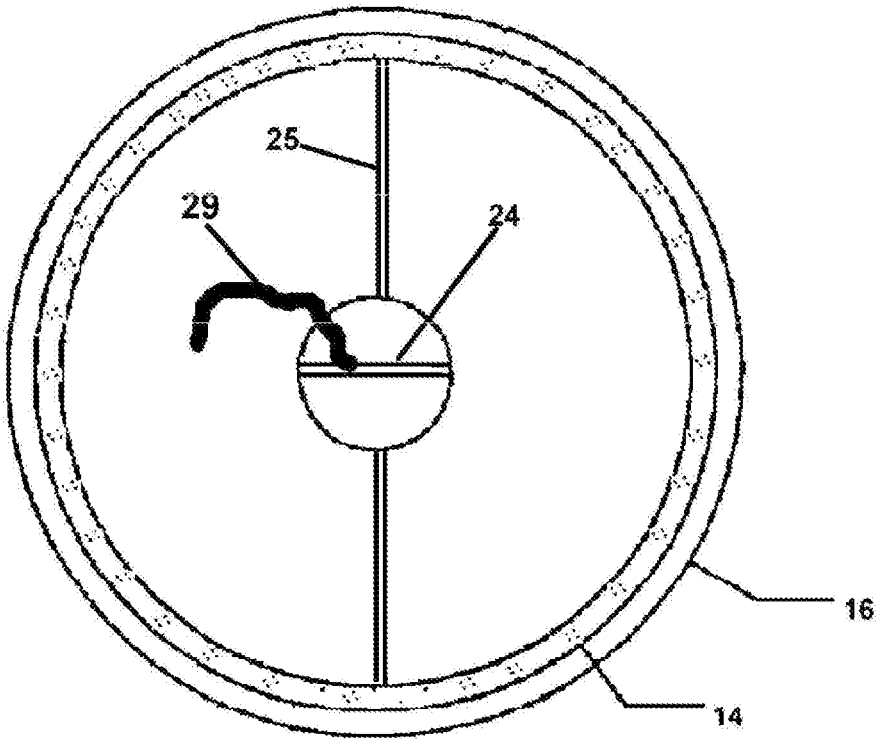
FIG. 5 depicts a top plan view of a mode of the device having a ring shaped magnet adjacent to the circumference of the body, a retaining member is shown at the center for tying of string or other components which might be employed during the process.

FIG. 5 depicts a top plan view of another mode of the device 10 having a ring shaped magnet 14 adjacent to the circumference of the body 16 portion. The body 16 portion is as shown, adapted to engage with or be supported by the flange 12, and provide the means to operatively position the magnet 14 in or proximal to the axial passage 11, in a position to communicate a magnetic attraction for the overlying ring 18. A retaining member 24 is shown at the center position and held there by a support member 25. The retaining member 24 is positioned for attaching a string or other component which might be employed during the process, or may be employed to support the garbage disposal during installation later on. Of course the retaining member 24 can just be the support member 25 however the employment of the retaining member 24 in a position that is perpendicular to the support member 25 provides additional utility.

The mode shown in FIG. 5, may also be adapted to just employ the body 16 as a support for the retaining member 24 which may be employed to connect to and thereby position the magnet 14 within or proximate to the axial passage 11 of the flange 12, in a position where the magnetic attraction from the magnet 14, will hold the ring 18. The magnet 14 may be suspended by a string or member from the retaining member 24 to achieve its suspended position to magnetically attract the attachment ring 18 during installation. However, a permanent engagement of the magnet 14 or magnets 14 in the favored modes of the device 10 herein is preferred.

Figure 6:
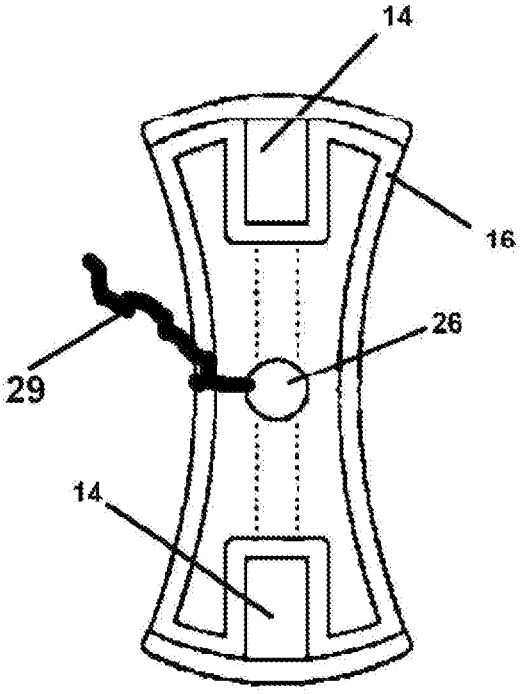
FIG. 6 shows a member-shaped mode of the device adapted to engage the flange across its diameter.

FIG. 6 shows a member-shaped mode of the device 10, having a length of the body 16 adapted to engage the flange 12 across its inner diameter, or suspended on the ledge 27 of the flange 12. A center aperture 26 is provided for mounting or tying of a string or lanyard 29 if desired for use during the installation or the installation of a garbage disposal in a second step. The plurality of magnets 14 are positioned on opposite ends of the body 16 however they may also be suspended below the body 16 of this or any other mode of the device 10 shown in the figures, since the basic device 10 encompasses a body 16 which is adapted to be supported by the flange 12 and thereby provide a support to position an engaged magnet or magnets 14, within the axial cavity 11 to a position whereby the a magnetic attraction to with the attachment ring 18 is achieved which is sufficient to hold it in a position on the exterior of the flange 12.

Figure 8:
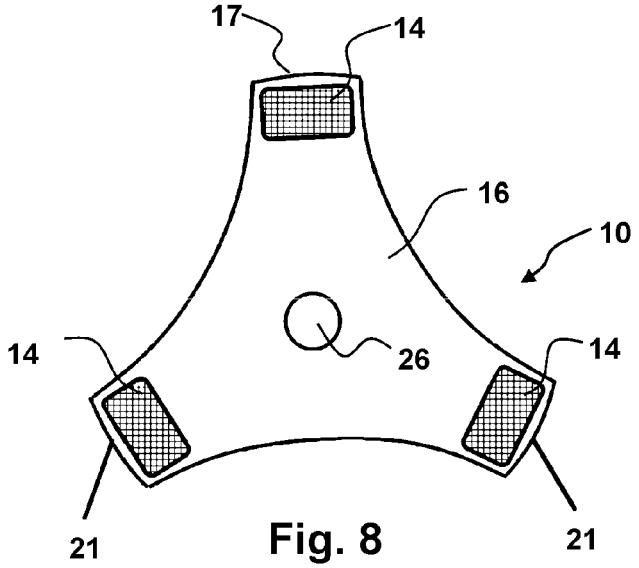
FIG. 8 show a bottom view of the device of FIG. 7 showing the plurality of engaged magnets thereon.

Shown in FIGS. 7 and 8 are a mode of the device 10 having a body 16 having a perimeter edge 17 formed at the distal end of each of three leg portions 21. As shown, a circumferential edge is defined by a circle running along the three curved perimeter edges 17, which has a diameter sized to support the body on the ledge, or on a sloping portion of the ledge 27, thereby operatively positioning each of three magnets 14, within an upper portion of the axial passage 11.

This configuration of the body 16 of FIGS. 7-8, positions each of the magnets 14, substantially equidistant from the other magnets 14, and has been found in experimentation, to yield a synergistic effect of combined magnetic fields from each of the magnets 14, to form a stronger combined magnetic field to attract and temporarily hold the ring assembly 18. Also shown are the aperture 26 which and be employed to engage a lanyard 29 (FIG. 6).

In a method of employment of the device 10 in all modes herein, a user would place the body 16 of the device which is connected to the operatively positioned magnet 14 or magnets 14, which communicate an attractive magnetic field to and through the sink flange 12, to thereby position the magnet 14 or magnets 14 in an operative position within or adjacent to the axial passage 11 of the sink flange 12. With the body 16 so positioned to communicate a magnetic field to the ring assembly 18 and impart a holding force to the ring assembly 18 to temporarily support to a ring assembly 18 without the need for contact thereafter with the hand of the user, the user will slide the ring assembly 18 upon the flange 12 and release contact, whereby the magnetic attraction provides a means to temporarily support the ring assembly 18 in an engagement with the flange 12.

As noted earlier, the device and method of employment shown in the drawings and described in detail herein disclose arrangements of elements of particular construction, and configuration for illustrating preferred embodiments of the tool employing magnetic attraction to hold ring assemblies 18 upon garbage disposal flanges 12 during engagement of the snap ring to retain them. It is to be understood, however, that elements of different construction and configuration, and using different steps and process procedures, and other arrangements thereof, other than those illustrated and described, may be employed for providing a means to suspend a magnetically attractive component within the axial passage 11 of a drain flange 12 for maintaining a garbage disposal attachment ring 18 upon a drain flange 12 during installation of the snap ring 20 and method in accordance with the spirit of this invention.

As such, while the present invention has been described herein with reference to particular embodiments thereof, a latitude of modifications, various changes and substitutions are intended in the foregoing disclosure, and will be appreciated that in some instance some features of the invention could be employed without a corresponding use of other features, without departing from the scope of the invention as set forth in the following claims. All such changes, alternations and modifications as would occur to those skilled in the art are considered to be within the scope of this invention as broadly defined in the appended claims.

What is claimed is:

1. An apparatus for temporarily supporting a mounting assembly for engaging a garbage disposal, upon a sink-engaged drain flange, comprising:

a body;

said body configured for a temporary engagement with a sink flange having a elongated barrel portion defining an axial passage through said sink flange;

at least one magnet in an engagement with said body;

said engagement of said magnet to said body being at a location which is positioned within or adjacent to said elongated barrel, with said body positioned to said temporary engagement;

said magnet while positioned within or adjacent to said elongated barrel communicating a magnetic attraction to said mounting assembly;

said magnetic attraction supporting said mounting assembly in an engagement with an exterior of said elongated barrel for a duration of time until said body is removed from said temporary engagement; and whereby with said body in said temporary engagement with said sink flange, said mounting assembly may be positioned to said engagement with said exterior of said elongated barrel by said user, and held in said engagement solely by said magnetic attraction, for said duration of time, during which said mounting assembly can be permanently attached in a fixed position to said barrel.

2. The apparatus of claim 1 having a plurality of said magnets in said engagement with said body.

3. The apparatus of claim 2 wherein said temporary engagement of said body with said sink flange comprises a frictional engagement of a circumferential surface of said body, within said axial passage.

4. The apparatus of claim 3 additionally comprising:

said plurality of said magnets engaged to said body in positions substantially equidistant from each other.

5. The apparatus of claim 2 wherein said temporary engagement of said body with said sink flange comprises an engagement of an exterior surface of said body, upon a horizontally disposed surface of said sink flange.

6. The apparatus of claim 5 additionally comprising:

said plurality of said magnets engaged to said body in positions substantially equidistant from each other.

7. The apparatus of claim 2 wherein said temporary engagement of said body with said sink flange comprises an engagement of a circumferential edge of said body, upon a horizontally disposed surface of said sink flange.

8. The apparatus of claim 2 additionally comprising:

said plurality of said magnets engaged to said body in positions substantially equidistant from each other.

9. The apparatus of claim 2 additionally comprising:

said plurality of magnets being a plurality of three magnets; and said magnets engaged to said body in positions substantially equidistant from each other.

10. The apparatus of claim 9 wherein said body has three leg portions extending therefrom; and a respective one of said plurality of three magnets located upon each of said three leg portions.

11. The apparatus of claim 1 wherein said temporary engagement of said body with said sink flange comprises a frictional engagement of a circumferential surface of said body, within said axial passage.

12. The apparatus of claim 11 wherein said at least one magnet is configured in the shape of a ring.

13. The apparatus of claim 1 wherein said temporary engagement of said body with said sink flange comprises an engagement of an exterior surface of said body, upon a horizontally disposed surface of said sink flange.

14. The apparatus of claim 13 wherein said at least one magnet is a single magnet configured in the shape of a ring.

15. The apparatus of claim 1 wherein said temporary engagement of said body with said sink flange comprises an engagement of a circumferential edge of said body, upon a horizontally disposed surface of said sink flange.

16. The apparatus of claim 15 wherein said at least one magnet is a single magnet configured in the shape of a ring.

17. The apparatus of claim 1 wherein said at least one magnet is configured in the shape of a ring.

* * * * *